United States Patent [19]

Snow, Jr.

[11] Patent Number: 4,995,466

[45] Date of Patent: Feb. 26, 1991

[54] METHOD AND DEVICE FOR STABILIZING THE PATH OF A DRILLING TOOL

[76] Inventor: Roy W. Snow, Jr., 2409 Oakhollow Dr., Newcastle, Okla. 73102

[21] Appl. No.: 455,976

[22] Filed: Dec. 22, 1989

[51] Int. Cl.[5] ..... E21B 7/10; E21B 7/08

[52] U.S. Cl. ..... 175/61; 175/76; 175/325

[58] Field of Search ..... 175/61, 73, 76, 325; 166/241

[56] References Cited

U.S. PATENT DOCUMENTS

| | | | |
|---|---|---|---|
| 2,173,309 | 9/1939 | Monroe | 175/76 |
| 3,105,562 | 10/1963 | Stone et al. | 175/268 |
| 3,154,156 | 10/1964 | Moore et al. | 175/76 |
| 3,156,310 | 11/1964 | Frisby | 175/76 |
| 3,171,503 | 3/1965 | Shirley | 175/269 |
| 3,386,521 | 6/1968 | Chadderdon et al. | 175/269 |
| 3,503,461 | 3/1970 | Shirley | 175/325 |
| 3,593,810 | 7/1971 | Fields | 175/76 |
| 4,080,115 | 3/1978 | Sims et al. | 418/48 |
| 4,083,405 | 4/1978 | Shirley | 166/285 |
| 4,220,213 | 9/1980 | Hamilton | 175/73 |
| 4,394,881 | 7/1983 | Shirley | 175/76 |
| 4,623,026 | 11/1986 | Kemp et al. | 175/76 |
| 4,635,736 | 1/1987 | Shirley | 175/76 |
| 4,844,178 | 7/1989 | Cendre et al. | 175/76 |

OTHER PUBLICATIONS

Drilco Drilling Assembly Handbook, 1977 ed., pp. 20–21 and 28.

*Primary Examiner*—Bruce M. Kisliuk

*Attorney, Agent, or Firm*—Dunlap, Codding Peterson & Lee

[57] ABSTRACT

An apparatus, and method of using the apparatus, for use in a drill string inserted into a borehole to stabilize the path of travel of a drilling tool. The apparatus is attached to the lower end of a drill string, and comprises a tubular section having a passageway therethrough communicating with the drill string passageway and a sleeve telescoped over the tubular section having at least two camming surfaces on the outer periphery thereof, the camming surfaces being substantially on opposite sides of the sleeve and spaced longitudinally along the sleeve. The rotation of the sleeve on the tubular section is selectively controlled.

7 Claims, 3 Drawing Sheets

METHOD AND DEVICE FOR STABILIZING THE PATH OF A DRILLING TOOL

FIELD OF THE INVENTION

The present invention generally relates to methods and devices for boring the earth, and, more specifically, to stabilizing the path of travel of a tool used to bore the earth.

SUMMARY OF THE INVENTION

The present invention comprises an apparatus for use in a drill string to stabilize the path of travel of a drilling tool attached to the lower end of the drill string. The apparatus comprises a tubular section secured in the drill string having a passageway therethrough communicating with the drilling fluid passageway through the remainder of the drill string. The outer wall of the tubular section is essentially circular in cross section. A sleeve telescopes over the tubular section which has at least two camming surfaces on the outer periphery thereof. The camming surfaces are substantially on opposite sides of the sleeve and are spaced longitudinally along the sleeve. The apparatus further comprises a means for selectively controlling rotation of the sleeve on the tubular section. The present invention also comprises a method for stabilizing the path of travel of a drilling tool attached to the lower end of a drill string utilizing the apparatus as described above.

DETAILED DESCRIPTION OF THE PREFERRED EMBODIMENTS

Figure 1:
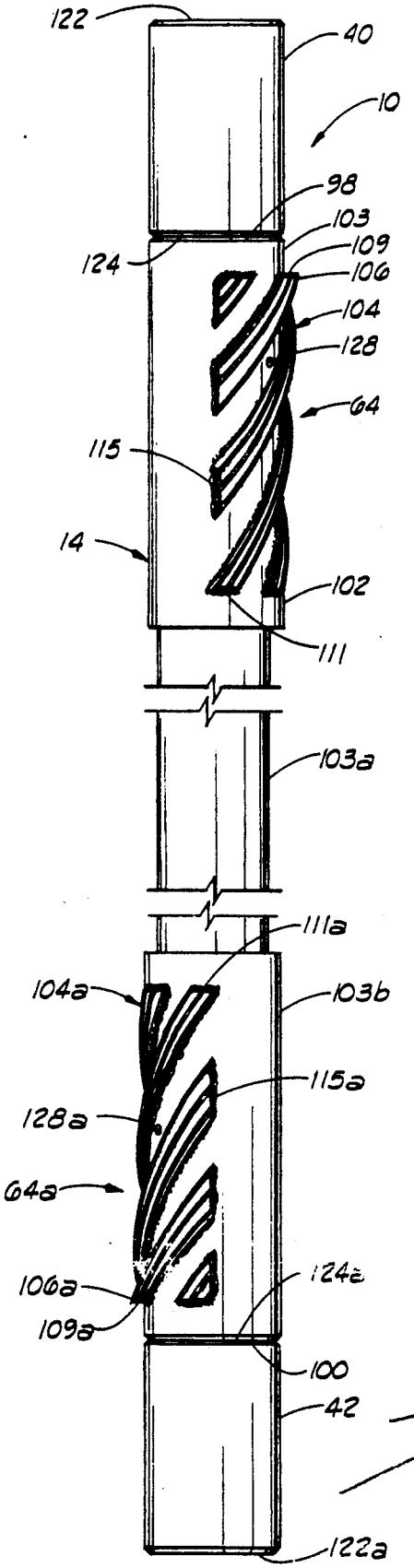
FIG. 1 is a side elevational view of the apparatus of the present invention.
Figure 2:
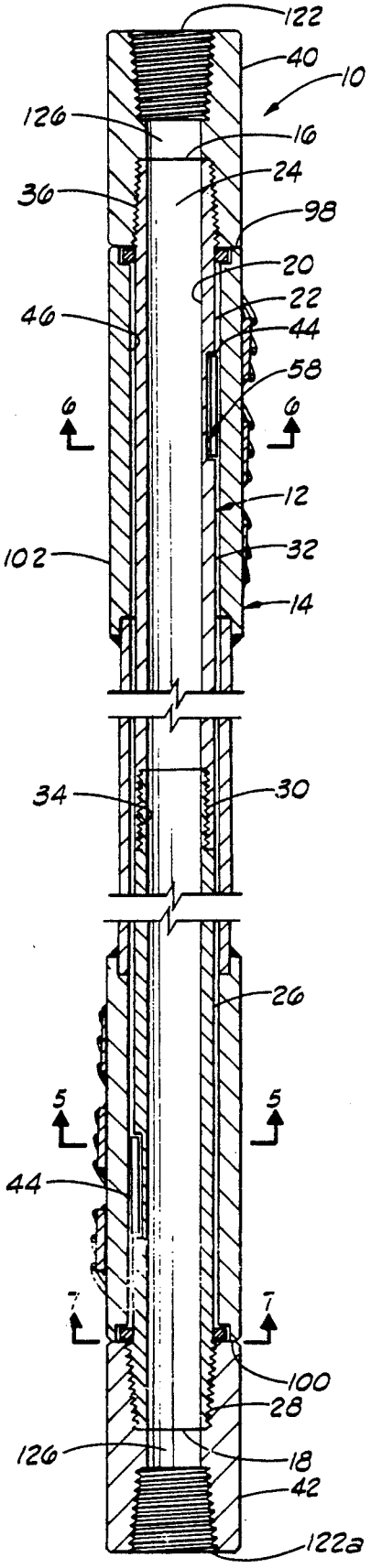
FIG. 2 is a vertical cross sectional view of the apparatus of the present invention as shown in FIG. 1.

Referring to the drawings in detail, and particularly FIGS. 1-2, reference character 10 generally designates an apparatus constructed pursuant to this invention. The apparatus 10 generally comprises a tubular section generally designated by the numeral 12, and a sleeve generally designated by the numeral 14 telescoped over the tubular section 12.

The tubular section 12 has a first end 16 and a second end 18; it is essentially circular in cross section having an inner wall 20 and an outer wall 22. The inner wall 20 of the tubular section 12 defines a passageway 24 which communicates with the drilling fluid passageway (not shown) in the drill string 25 (FIG. 10) so that fluid flowing through the drilling fluid passageway will flow through the tubular section passageway 24. The outer wall 22 of the tubular section 12 is preferably about the same outer diameter as the drill string 25. The tubular section passageway 24 may be any size that will permit the passage of fluid as described herein but maintain the structural integrity of the tubular section 12 while in use. Preferably the tubular section passageway 24 is the same size as the drilling fluid passageway (not shown). The tubular section 12 is at least as long as the sleeve 14, described hereafter, and is preferably a little longer.

Figure 3:
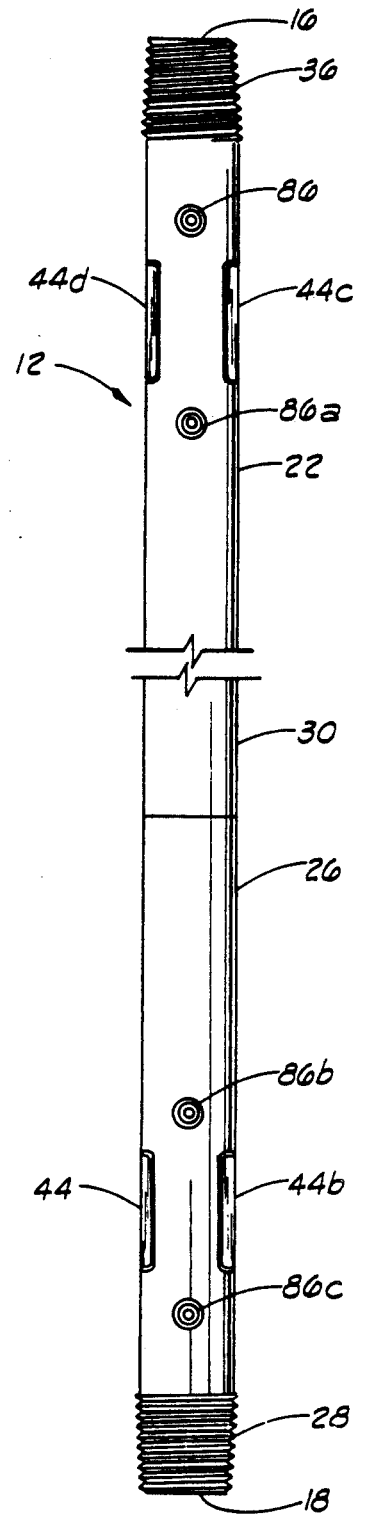
FIG. 3 is a side elevational view of a tubular section of the present invention.

In the embodiment shown in FIGS. 2 and 3, the tubular section 12 comprises a first tubular segment 26 having a first end portion 28 and a second end portion 30 and a second tubular segment 32 having a first end portion 34 and a second end portion 36. Preferably, the second end portion 30 of the first tubular segment 26 is taper threaded. The first end portion 34 of the second tubular segment 32 is internally threaded to threadingly receive and engage the second end portion 30 of the first tubular segment 26.

The tubular section 12 may be secured to the drill string 25 by any means or may be secured to couplings which are securable to the drill string 25. Preferably, the tubular section first end 16 and second end 18 (the first end portion 28 of the first tubular segment 26 and the second end portion 36 of the second tubular segment 32 when the tubular section 12 comprises two segments) are taper threaded Which threadingly receive and secure couplings 40 and 42, as described hereafter.

Figure 4:
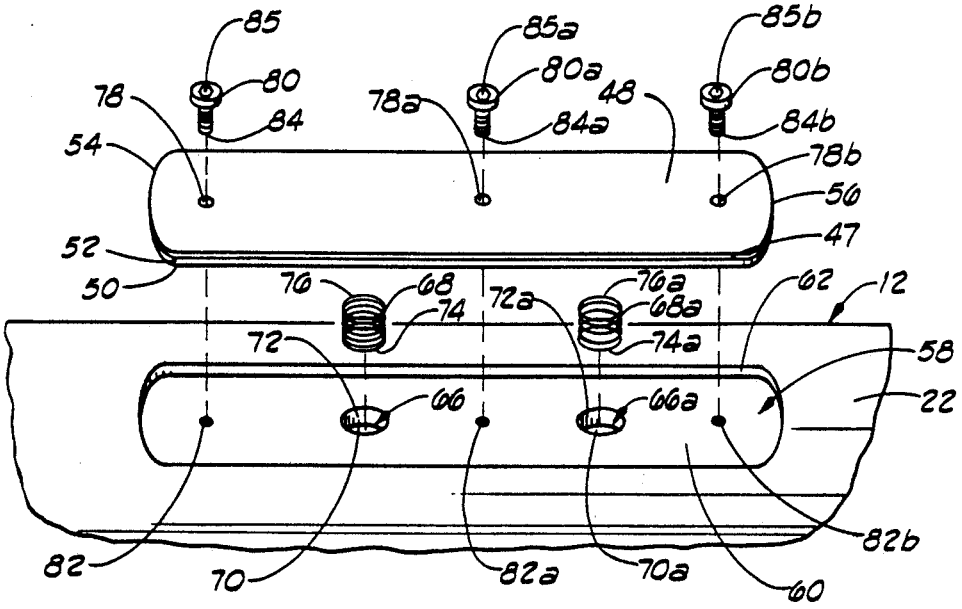
FIG. 4 is an exploded view of a portion of the tubular section shown in FIG. 3 showing a shoe and recessed portion.

The tubular section 12 further comprises at least one shoe 44 carried by the tubular section 12 which is urged into frictional engagement with the inner periphery 46 of the sleeve 14, as described hereafter. As shown in FIG. 4, the shoe 44 comprises an outer surface 48 and an inner surface 50 with a shoe wall 52 therebetween, and a first end 54 and a second end 56. The shoe 44 may be of any size or shape and may be constructed from any material that will function as described herein.

Each shoe 44 is received in a recessed portion, generally designated by the numeral 58, on the outer wall 22 of the tubular section 12, wherein each recessed portion 58 has a support surface 60, and a recessed portion wall 62 between the outer wall 22 of the tubular section 12 and the support surface 60. The recessed portion 58 is sized to snugly receive the shoe 44 wherein the shoe inner surface 50 rests on the recessed portion support surface 60 when no pressure is applied to the shoe; in this position, the outer surface 48 of the shoe 44 is preferably about flush with the outer wall 22 of the tubular section 12.

As previously described, the shoe 44 is urged into frictional engagement with the inner periphery 46 of the sleeve 14. "Frictional engagement" means that the shoe 44 contacts the inner periphery 46 of the sleeve 14, as described hereafter, so that the sleeve 14 and the tubular section 12 rotate together. This frictional engagement can be overcome in order to selectively control the rotation of the sleeve 14, as more fully described hereafter.

Referring to FIG. 4, one way to accomplish this frictional engagement between the shoe 44 and the inner periphery 46 of the sleeve 14 is to have at least one, and preferably two, reservoirs, generally designated by the numerals 66 and 66*a*, in the recessed portion support surface 60 which receive respectively springs 68 and 68*a* therein. The reservoirs 66 and 66*a* are sized to receive springs 68 and 68*a* capable of urging the shoe 44 into the position described herein, and sized to maintain the structural integrity of the tubular section 12. Preferably, the reservoirs 66 and 66*a* have planar reservoir support surfaces 70 and 70*a* to support the springs 68 and 68*a*, and annular reservoir walls 72 and 72*a* disposed between the reservoir support surfaces 70 and 70*a* and the recessed portion support surfaces 60 and 60*a*. The springs 68 and 68*a* respectively have first ends 74 and 74*a* and second ends 76 and 76*a*; the first ends 74 and 74*a* contact the reservoir support surfaces 70 and 70*a* while the second ends 76 and 76*a* contact the shoe inner surface 50. The springs 68 and 68*a* have enough length and resiliency to urge the shoe 44 a distance from the recessed portion 58 into frictional engagement with the inner periphery 46 of the sleeve 14.

On at least a portion of the outer surface 48 of the shoe 44 is preferably an effective amount of a frictionally wearable material 47. "Frictionally wearable material" means a material which will wear off substantially easier when contacted by the sleeve 14 than the material from which the tubular section 12 is constructed thereby reducing frictional damage between the sleeve 14 and the tubular section 12. An "effective amount" of the frictionally wearable material means an amount which will prevent substantial friction damage between the sleeve 14 and the tubular section 12. In a preferred embodiment, a ¼ inch layer of bearing bronze is applied by welding the bearing bronze to the shoe upper surface 48.

As shown in FIG. 4, the shoe 44 preferably has three apertures 78, 78*a*, and 78*b* from the shoe outer surface 48 to the shoe inner surface 50 to receive three threaded bolts 80, 80*a*, and 80*b* respectively therethrough. The bolts 80, 80*a*, and 80*b* are received through the shoe apertures 78, 78*a*, and 78*b* and secured in apertures 82, 82*a*, and 82*b* in the support surface 60 of recessed portion 58. The bolts 80, 80*a*, and 80*b* are sized so that the bolt lower ends 84, 84*a*, and 84*b* are secured in the recessed portion apertures 82, 82*a*, and 82*b* while the bolt upper ends 85, 85*a*, and 85*b* extend a sufficient distance from the recessed portion apertures 82, 82*a*, and 82*b* to permit a maximum distance traveled by the shoe 44 from the recessed portions 58 in order to prevent dislodging of the shoe 44 during operation.

Figure 5:
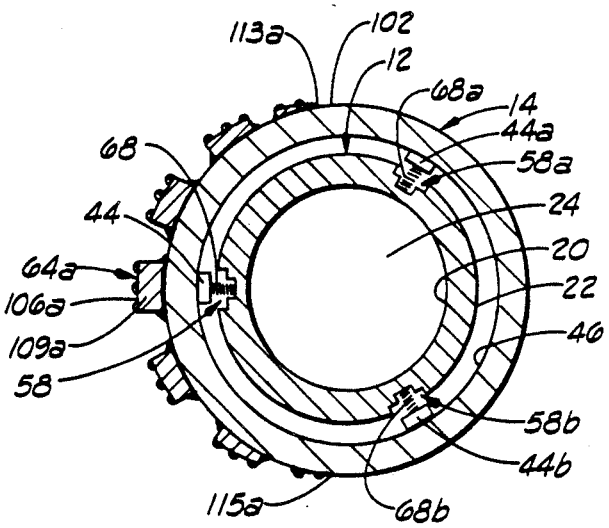
FIG. 5 is cross sectional view of the apparatus of the present invention taken along lines 5—5 in FIG. 2.
Figure 6:
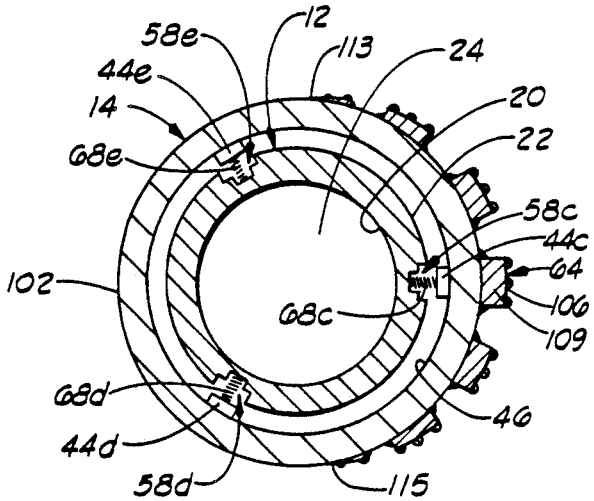
FIG. 6 is a cross sectional view of the apparatus of the present invention taken along lines 6—6 in FIG. 2.
Figure 7:
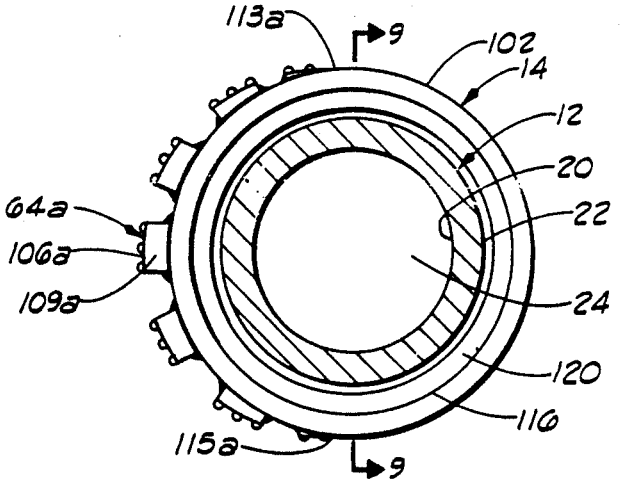
FIG. 7 is a partial cross sectional view of the apparatus of the present invention taken along lines 7—7 in FIG. 2.

In a preferred embodiment shown in FIGS. 5 and 6, there are six shoes 44, 44*a*, 44*b*, 44*c*, 44*d*, and 44*e*; each shoe is snugly received in one of six recessed portions 58, 58*a*, 58*b*, 58*c*, 58*d*, and 58*e*. Each recessed portion 58, 58*a*, 58*b*, 58*c*, 58*d*, and 58*e* contains two reservoirs 66 and 66*a*, as shown in FIG. 4, which respectively receive springs 68 and 68*a*. Any springs may be used which apply sufficient pressure to the shoes as described herein.

Preferably three shoes 44, 44*a*, and 44*b*, as shown in FIG. 5, are respectively received in three recessed portions 58, 58*a*, and 58*b* which are spaced about equidistance from each other circumferentially about a portion of the tubular section 12. Another set of three shoes 44*c*, 44*d*, and 44*e*, as shown in FIG. 6, are respectively received in three recessed portions 58*c*, 58*d*, and 58*e* which are spaced about equidistance from each other circumferentially about a portion of the tubular section 12. Preferably these two sets of three shoes in recessed portions are spaced longitudinally a distance apart, and more preferably these sets are positioned on the tubular section 12 so that at least one of the shoes in each set is urged against the inner periphery 46 of the portion of the sleeve 14 which carries the camming surfaces 64 and 64*a* as described hereafter.

Figure 8:
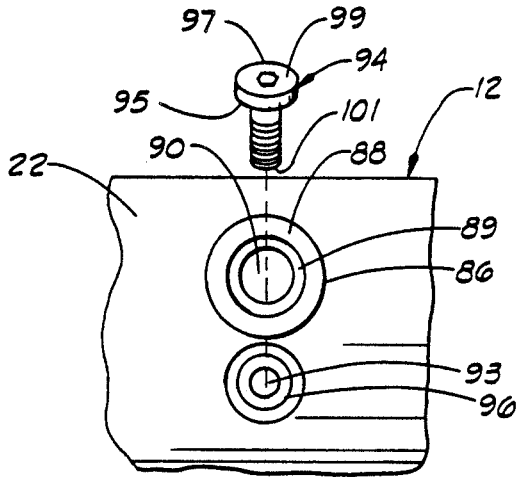
FIG. 8 is an exploded view of a portion of the tubular section shown in FIG. 3 showing a wear pad.

The tubular section 12 may further comprise at least one wear pad 86, as shown in FIG. 8, having an outer surface 88 and an inner surface (not shown) constructed from frictionally wearable material such as bearing bronze. In a preferred embodiment, the wear pad 86 is a flattened bearing bronze ring having an annular lip 89 recessed a distance from the outer surface 88 defining passageway 90 through the middle of the ring which is sized to receive a threaded bolt, generally designated by the numeral 94, therethrough. The wear pad 86 and the lower end 101 of the bolt 94 are received in a wear pad cavity 96 located on the outer wall 22 of the tubular section 12. The lower end 101 of the bolt 94 is secured in the wear pad cavity bolt aperture 93 thereby securing the wear pad 86 in the wear pad cavity 96. When the wear pad 86 is in the cavity 96, the lower surface 95 of bolt head 97 is supported on the lip 89 so that the upper surface 99 of the bolt head 97 is recessed a distance from the outer surface 88 of the wear pad 86, and the outer surface 88 of the wear pad 86 preferably extends a short distance from the outer wall 22 of the tubular section 12.

The wear pad 86 functions to reduce friction damage between the sleeve 14 and the tubular section 12: the sleeve 12 contacts the wear pad 86 before contacting the tubular section 12. In a preferred embodiment, there are twelve wear pads 86, 86*a*, 86*b*, and 86*c* carried by the tubular section 12.

The sleeve 14 telescopes over at least a portion of the tubular section 12. The sleeve 14 comprises a first end 98, a second end 100 and is generally circular in cross section. The sleeve 14 further comprises an inner periphery 46 and an outer periphery 102. In the embodiment shown in the drawings, the sleeve 14 is constructed from three sleeve segments 103, 103*a* and 103*b* welded together having a uniform inner diameter. The sleeve 14 is sized to fit into a borehole and preferably has an inside diameter slightly larger than the outside diameter of the tubular section 12. In a preferred embodiment, the clearance between the inner diameter of the sleeve 14 and the outer diameter of the tubular section 12 is 1/16 inch. Preferably, the sleeve 14 is about 2 feet to about 10 feet long, and, more preferably, about 2 feet to about 15 feet long.

The sleeve 14 has at least two camming surfaces generally designated by the numerals 64 and 64*a*, on the outer periphery 102 of the sleeve 14, substantially on opposite sides of the sleeve 14 and spaced a distance apart longitudinally along the sleeve 14. The camming surfaces 64 and 64*a* are sized such that the apparatus 10 will fit into a borehole and function as described herein.

Any type of camming surfaces 64 and 64*a* may be utilized in the present invention which are capable of functioning as defined herein. In a preferred embodiment, the camming surfaces 64 and 64*a* are formed by welding strips of steel 104 and 104*a* diagonally across a portion of the sleeve 14 preferably near each end 98 and 100 of the sleeve 14. The camming surfaces 64 and 64*a* respectively have first ends 109 and 109*a* and opposing second ends 111 and 111*a*, and third ends 113 and 113*a* and opposing fourth ends 115 and 115*a*. The distance between the third ends 113 and 113*a* and the fourth ends 115 and 115*a* cover an area of about 180° of the circumference of the sleeve. The distance between the first ends 109 and 109a and the second ends 111 and 111a is about 1½ feet long.

The strips of steel 104 and 104a are selectively nonuniform in thickness such that the camming surfaces 64 and 64a taper respectively towards apexes 106 and 106a about midpoint between the third ends 113 and 113a and the fourth ends 115 and 115a near the first ends 109 and 109a of the camming surfaces 64 and 64a. Additionally, welding beads 107 may be applied to the strips of steel 104 in order to selectively increase the height of the camming surfaces 64 and 64a. In a preferred embodiment, the camming surfaces 64 and 64a are about ⅝ inch from the outer periphery 102 of the sleeve 12 to the apex 106. The height of the apex 106 may vary depending upon the type of drilling operation as long as the camming surfaces 64 and 64a function as described herein.

The camming surfaces 64 and 64a are preferably about 1 to about 30 feet apart longitudinally, and more preferably about 1 to about 15 feet apart. In a preferred embodiment, the camming surfaces 64 and 64a are 7 feet apart longitudinally.

Figure 9:
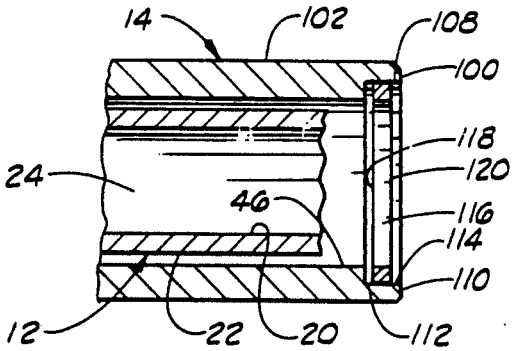
FIG. 9 is a cross sectional view of an end portion of the sleeve taken along line 9—9 in FIG. 7, wherein a portion of the tubular section has been cut away for clarity.

Each end 98 and 100 of the sleeve 14 may form an annular flange element 108, as shown in FIG. 9. Each flange element 108 has a first end 110 and a second end 112 defining therebetween a flange support surface 114. Each of the flange support surfaces 114 receive a floating ring 116. Each floating ring 116 comprises a first end 118 and a second end 120. The ring 116 is sized to snugly fit on the flange support surface 114 of the flange element 108, but has a width (distance from the first end 118 to the second end 120) less than the distance between the first end 110 and the second end 112 of the flange element 108. The inner diameter of each ring 116 is preferably only slightly larger than the outer diameter of the tubular section 12 in order to fit snugly thereon. Each floating ring 116 is movably responsive from about the second end 112 of the flange element 108 to about the first end 110 of the flange element 108 when pressure is applied to the floating ring 116, as described hereafter.

Each floating ring 116 is preferably prevented from moving past the first end 110 of the flange element 108 by the couplings 40 and 42, although other methods to secure the floating ring 116 in the flange element 108 may be utilized. Each coupling 40 and 42 has a first end 122 and 122a and a second end 124 and 124a with a passageway 126 therethrough. The second ends 124 and 124a of each coupling 40 and 42 threadingly receive and engage the terminal ends 16 and 18 of the tubular section 12. The first ends 122 and 122a of each coupling 40 and 42 are capable of threadingly engaging either the drill string 25 or the drill bit 123.

The sleeve 14 further comprises at least one, and preferably two, lubricant inserting apertures 128 and 128a from the sleeve outer periphery 102 to the sleeve inner periphery 46. A sufficient amount of lubricant such as oil is inserted into the lubricant apertures 128 and 128a in order to prevent friction damage between the tubular section 12 and the sleeve 14. A sufficient amount of lubricant is an amount which will substantially cover the area between the sleeve 14 and the tubular section 12 but permit the floating ring 116 to remain at about the second end 112 of the flange element 108. The floating rings 116 provide a barrier against a substantial amount of material entering the area between the sleeve 14 and the tubular section 12, and provide a barrier against a substantial amount of the lubricant escaping the apparatus 10.

There will be an increase in pressure on the apparatus 10 as the apparatus 10 is lowered into the borehole. The floating rings 116 are capable of movement so as to react to pressures from inside the apparatus 10 and pressures exerted on the apparatus 10: the floating rings 116 move from the second ends 112 of the flange elements 108 to the first end 110 of the flange element 108.

The length of the flange support surface 114 and the width of the floating rings 116 may vary. In a preferred embodiment, the support surface 114 is ⅞ inch and the width of the floating rings 116 are ½ inch.

Figure 10:
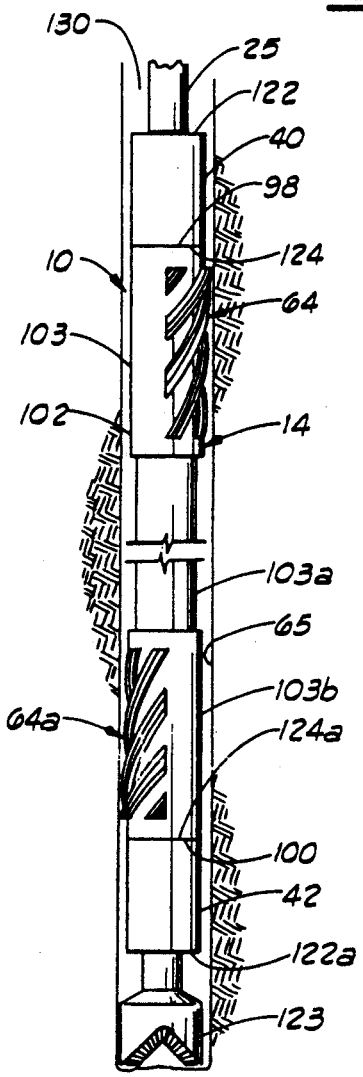
FIG. 10 is a side elevational view showing the apparatus secured to the drill string and a drill bit in a borehole.

In operation as shown in FIG. 10, the apparatus 10 is attached to the drill string 25, preferably directly above the drill bit 123 such that one end of the apparatus 10 is threadingly secured to the terminal end of the drill string 25 and the other end of the apparatus 10 is threadingly secured to the drill bit 123. The drill string 25 is lowered into the borehole 130, and the drill string 25 rotated for the drill bit 123 to operate.

The drill bit 123 often deviates from its intended relatively straight course usually due to hard formations encountered by the drill bit 123. When the drill bit 123 alters its intended straight path of travel, the drill string 25 bends. With the present invention, as the drill string 25 bends, the camming surfaces 64 and 64a contact opposite sides of the borehole wall 65. During this contact, the sleeve 14 reduces the speed of its rotation while the tubular section 12 continues to rotate with the drill string 25 and the drill bit 123. When the apexes 106 and 106a of the camming surfaces 64 and 64a respectively contact opposite sides of the borehole wall, a transverse movement in one end of the apparatus 10 is produced by camming surface 64, and a transverse movement in the opposite direction is produced in the other end of the apparatus 10 by camming surface 64a which straightens the apparatus 10 and the attached drill string 25 and drill bit 123. This stabilizes the path of travel of the drilling tool so that a relatively straight borehole is obtained.

Having a relatively straight borehole means time and money saved by the drilling operator in reaching the desired borehole depth. Additionally, the present invention also permits the application of more pressure to the drill bit 123 since bends in the drill string 25 will be corrected; this reduces the time, and therefore the expense required to drill a borehole to a desired depth.

The present invention also contemplates using more than one apparatus 10 in a drill string. The apparatus 10 on a drill string can be separated by a drill collar from the other apparatus 10 (not shown) or more than one apparatus can be positioned next to each other on the drill string.

Changes may be made in the combination and arrangement of parts or elements as heretofore set forth without departing from the spirit and scope of the invention as defined in the following claims.

What is claimed is:

1. An apparatus for use in a drill string having a drilling fluid passageway inserted into a borehole to stabilize the path of travel of a drilling tool in a borehole attached to the lower end of the drill string, comprising:

a tubular section secured in the drill string having a passageway therethrough communicating with the drilling fluid passageway through the remainder of the drill string, and having an outer wall essentially circular in cross section;

a sleeve telescoped over said tubular section having at least two camming surfaces on the outer periphery thereof substantially on opposite sides of the sleeve and spaced longitudinally along the sleeve; and means for selectively controlling rotation of the sleeve on the tubular section comprising:

at least one shoe carried by the tubular section; and means for urging the shoe into frictional engagement with the inner periphery of the sleeve comprising:

at least one recessed portion in the outer periphery of the tubular section sized to receive the shoe;

at least one reservoir in the recessed portion sized to receive a spring; and said spring disposed in the reservoir capable of urging the shoe into frictional engagement with the inner periphery of the sleeve, wherein the shoe is disposed in the recessed portion.

2. The apparatus of claim 1 wherein the tubular section comprises six shoes respectively carried in six recessed portions.

3. The apparatus of claim 2 wherein three of the recessed portions carrying shoes are spaced equidistance from each other circumferentially about a portion of the tubular section and longitudinally spaced a distance from the other three recessed portions carrying shoes which are spaced equidistance from each other circumferentially about a portion of the tubular section.

4. The apparatus of claim 1 wherein the tubular section comprises two reservoirs containing springs in each recessed portion.

5. The apparatus of claim 1 wherein the shoe comprises an outer surface and an inner surface which contacts the spring, and further comprising means for reducing friction damage between the tubular section and the sleeve, comprising:

securing an effective amount of a frictionally wearable material on at least a portion of the outer surface of the shoe.

6. The apparatus of claim 5 wherein the frictionally wearable material comprises bronze.

7. A method for stabilizing a path of travel of a drilling tool in a borehole, the drilling tool being attached to a lower end of a drill string having a drilling fluid passageway therethrough, comprising:

attaching an apparatus to the drill string wherein the apparatus has a first end and a second end, the first end being attached to a portion of the drill string, wherein the apparatus comprises:

a tubular section secured in a portion of the drill string having a passageway therethrough communicating with the drilling fluid passageway, and having an outer wall essentially circular in cross section;

a sleeve telescoped over said tubular section having at least two camming surfaces on the outer periphery thereof substantially on opposite sides of the sleeve and spaced longitudinally along the sleeve; and means for selectively controlling rotation of the sleeve on the tubular section comprising:

at least one shoe carried by the tubular section; and means for urging the shoe into frictional engagement with the inner periphery of the sleeve, comprising:

at least one recessed portion in the outer periphery of the tubular section sized to receive the shoe;

at least one reservoir in the recessed portion sized to receive a spring; and said spring disposed in the reservoir capable of urging the shoe into frictional engagement with the inner periphery of the sleeve; and attaching the second end of the apparatus to one of another drill string terminating in a drilling tool or a drilling tool;

inserting the drilling tool, apparatus and at least a portion of the drill string into the borehole; and rotating the drilling tool, apparatus and drill string thereby drilling a path of travel, wherein the camming surfaces are capable of contacting walls of the borehole when the drilling tool deviates from a substantially straight bath of travel realigning the path of travel in the drilling tool in a substantially straight path of travel.

* * * * *

UNITED STATES PATENT AND TRADEMARK OFFICE

CERTIFICATE OF CORRECTION

PATENT NO. : 4,995,466

DATED : February 26, 1991

INVENTOR(S) : Roy W. Snow, Jr.

It is certified that error appears in the above-identified patent and that said Letters Patent is hereby corrected as shown below:

Column 2, line 34, the word "Which" should be --which--.

Column 4, line 30, after the word, sleeve, the number "12" should be --14--.

Column 8, line 43, after the word, travel, the word --thereby-- should be inserted.

Column 8, line 43, the word "bath" should be --path--.

Signed and Sealed this

Fifteenth Day of September, 1992

*Attest:*

DOUGLAS B. COMER

*Attesting Officer*

*Acting Commissioner of Patents and Trademarks*